United States Patent [19]

Anton et al.

[11] 4,064,982

[45] Dec. 27, 1977

[54] PRINTING RIBBON

[75] Inventors: Rainer Anton, Nuremberg; Ernst Beyer, Hannover; Bodo Bielefeld, Hemmingen, all of Germany

[73] Assignee: Triumph Werke Nurnberg A.G., Nuremberg, Germany

[21] Appl. No.: 724,526

[22] Filed: Sept. 20, 1976

[51] Int. Cl.[2] ..... B41J 31/05

[52] U.S. Cl. ..... 197/1 R; 101/DIG. 13; 197/172

[58] Field of Search ..... 197/1 R, 172; 346/76 R, 346/139 C, 74 J, 74 R, 1, 74 ES; 101/114, 1, DIG. 13, 426

[56] References Cited

U.S. PATENT DOCUMENTS

| | | | |
|---|---|---|---|
| 3,359,398 | 6/1968 | Engstrom et al. | 101/1 |
| 3,550,153 | 12/1970 | Haeberle et al. | 346/74 |
| 3,719,261 | 3/1973 | Heinzer et al. | 346/76 R X |
| 3,744,611 | 7/1973 | Montanari et al. | 346/76 R X |
| 3,824,924 | 7/1974 | Rarey et al. | 101/114 |
| 3,847,265 | 11/1974 | Ehretsmann | 197/172 |
| 3,857,470 | 12/1974 | Bastard et al. | 197/1 R |
| 3,995,729 | 12/1976 | Anton et al. | 197/1 R |

*Primary Examiner*—Ralph T. Rader
*Attorney, Agent, or Firm*—Joseph R. Spalla

[57] ABSTRACT

An improved printing ribbon for use between a writing electrode and a permeable counterelectrode across which a pulse of predetermined magnitude and duration is applied. The material of the ribbon is such that it experiences multiple electric breakdowns causing it to be propelled through the permeable counterelectrode onto a record sheet held adjacent the permeable counterelectrode outside the sandwich. In a preferred embodiment, the ribbon is provided with a metallized coating which serves as the permeable counterelectrode.

5 Claims, 4 Drawing Figures

PRINTING RIBBON

This invention relates to transfer means for use in a method for direct electrostatic recording such as is described in application Ser. No. 642,295, filed Dec. 19, 1975, entitled IMPACTLESS PRINTING APPARATUS by Anton et al now U.S. Pat. No. 3,995,729, issued Dec. 7, 1976.

In said U.S. Pat. No. 3,995,729, which is incorporated by reference herein, a printing ribbon is sandwiched between a writing electrode and a permeable counterelectrode and, when a voltage pulse of predetermined magnitude and duration is applied, multiple dielectric breakdowns occur in the ribbon causing marking material therein to move or to be propelled through the permeable counterelectrode onto a record carrier. The energy converted, which serves to propel marking material of the ribbon, is believed to be the result of electrical breakdowns of dielectric materials as well as to heating due to internal conductive paths in the materials of the ribbon which precedes and directs the course of the breakdown paths within the ribbon.

Ribbons, according to the invention, must experience a multiplicity of electrical breakdowns in extremely short time intervals to achieve transfers as will produce crisp recording and, to experience multiple breakdowns in short time intervals the voltage applied across the sandwich must be much higher than, on the order of 10 times, the breakdown voltage of the ribbon. On the other hand, applied voltages, for safety purposes, should be no higher than 300 volts.

Accordingly, ribbons in sheet or strip form must employ materials as will enable the amount of energy to be converted for the particle mobility required to be kept as small as possible while at the same time to keep the breakdown voltage low relative to the applied voltage. Ribbons with these characteristics are achieved by controlling thickness dimensions and the effective dielectric constant as by selection of materials.

In said U.S. Pat. No. 3,994,729, there is disclosed a printing ribbon comprising a carrier of woven mesh nylon material in whose interstices marking material is lodged. Due to the woven mesh carrier, the image of the writing produced on the recording paper is broken up by the pattern of the carrier.

To obviate this patterned effect, ribbons in accordance with the invention comprise discrete layers of marking material which may be coated on conductive paper or which may be self-supporting. These produce patternless images as distinguished from patterned images produced by a ribbon comprising a woven or nonwoven carrier which carry in their interstices marking material of the requisite characteristics.

In accordance with the preferred embodiment of the invention, the film of self-supporting marking material or the coated carrier may be provided with a conductive film which serves as the permeable electrode through which the marking material is propelled to a record.

Accordingly, an object of the invention is in the provision of a transfer means having marking material constituents so chosen with consideration to the area of writing electrodes as to achieve local transfer of marking material within a predetermined time and with as low an applied voltage as possible.

Another object of the invention is to provide a ribbon having a continuous layer of marking material which will experience multiple dielectric breakdowns at low applied voltages of very short duration to effect transfers which produce clean, unpatterned recording.

Other objects, features and advantages of the present invention will become apparent from a reading of the following detailled description when taken in conjunction with the accompanying drawing wherein like reference numerals designate like or corresponding parts throughout the views thereof and wherein:

FIG. 1 is a schematic view of elements comprising the printing apparatus disclosed in said U.S. Pat. No. 3,995,729 employing a printing ribbon in accordance with the invention;

Figure 1:
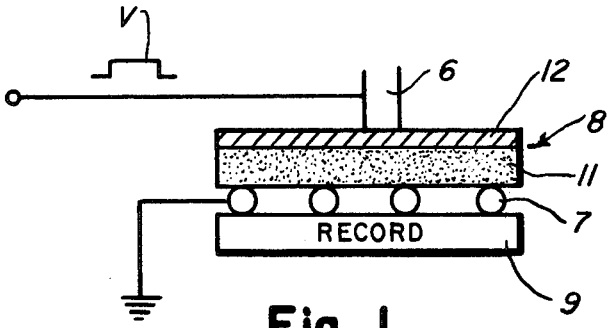

Referring now to the drawing, there is shown in FIG. 1 a writing electrode 6 and a screen or permeable counterelectrode 7 across which a voltage pulse V of predetermined magnitude and duration is applied. Between the electrodes 6 and 7 is a printing ribbon, generally designated by reference numeral 8, which, in response to the applied voltage, experiences multiple dielectric breakdowns opposite the writing electrode 6 whereby marking materials comprising the ribbon are propelled through the screen counterelectrode 7 to a record 9 located adjacent the screen electrode 7 on the side opposite the side in contact with the ribbon 8.

In accordance with the invention herein, to avoid the patterned images of the writing electrode due to the ribbon disclosed in said U.S. Pat. No. 3,995,729, a ribbon having the requisite characteristics comprises discrete cast or coated films of marking material.

With reference to FIG. 1, such a ribbon, in accordance with the invention, comprises a discrete layer 11 of marking material comprising binders and pigments coated on one side of a conductive paper carrier 12. The conductive paper carrier 12 may comprise sodium papers of great tear strength in weights of from 10 – 20 grams/meter$^2$ impregnated with conductive salts. This ribbon is placed with the paper side in contact with the writing electrode 6 which protects the writing electrode from contamination by the marking material of layer 11. Recorded images of the writing electrode 6 produced with such a ribbon 8 are free of the shadow pattern of the woven mesh carrier disclosed in said Anton et al application.

The following formulation of such a ribbon, as shown in FIG. 1, has proven to be particularly advantageous:

Carrier: Sodium cellulose paper, unbleached, 16 g/m$^2$, impregnated with a 10% solution of ammonium rhodanide in water and dried.

Constituents of marking material solution by weight:

20 parts soot, such as known by the tradename "Printex 140 V vacuum compacted";

5 parts graphite powder;

110 parts ethanol;

30 parts mineral spirit.

The marking material solution is applied 10 gms/meter$^2$ to the carrier 12.

Figure 2:
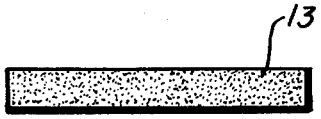
FIG. 2 is a transverse cross-sectional view of another embodiment of a printing ribbon in accordance with the invention as may be employed in the printing apparatus shown in FIG. 1.

With reference to FIG. 2, another embodiment of a ribbon in accordance with the invention for use in the apparatus of FIG. 1 comprises a discrete cast self-supporting film 13 of marking material made from film forming binders and pigments. This embodiment eliminates the necessity for a carrier for the marking material. A cast ribbon so constructed is clean to the touch and produces characters resistant to smearing, yet avoids fouling of the writing and screen electrodes when used in the FIG. 1 configuration. Too, such a printing ribbon 13 due to the continuous film structure, results in recorded images free of the shadow patterns evident with a ribbon wherein the marking material is carried within interstitial spaces of a web.

An example of the formulation of a ribbon shown in FIG. 2, which was found to produce clean writing, comprised the following constituents by weight:

37.5 parts soot or carbon black, e.g. that sold under the tradename "Printex 140 V vacuum compacted";

138 parts polyvinyl alcohol, highly viscous, partly saponified, such as known by the tradename "Mowiol-Iosung 40/88", 15% in water;

17.2 parts glycerin-triox-ethyl ether;

180 parts water for viscosity adjustment.

The above are mixed and cast to produce a film having a bone dry weight of 20 grams/meter$^2$.

In addition, it has been found that the ribbons shown in FIGS. 1 and 2 can be coated on one side with a conductive coating applied as by a vapor metallizing process which coating can serve as the screen electrode shown in FIG. 1.

Figure 3:
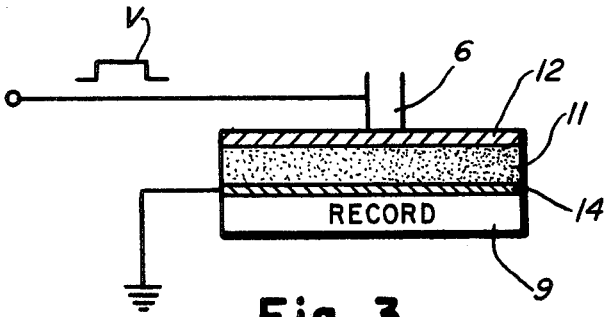
FIG. 3 is a schematic view of a printing apparatus employing a printing ribbon as shown in FIG. 1 modified by the addition of a vapor deposited metal coating which serves as a permeable counterelectrode.
Figure 4:
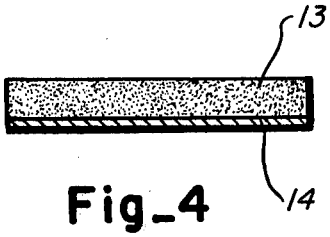
FIG. 4 is a transverse cross-sectional view of a ribbon similar to that of FIG. 2 modified by the addition of a vapor deposited metal coating which serves as a permeable counterelectrode.

FIGS. 3 and 4 show the ribbons of FIGS. 1 and 2 with a metallized coating 14. As seen in FIG. 3, the screen electrode 7 of FIG. 1 is no longer necessary as the metallized coating 14 on the ribbon serves as the screen electrode. The application of voltage across the writing electrode 7 and the metallized coating 13 results in multiple dielectric breakdowns which propel marking material to the record 9. In addition to eliminating the screen electrode 7 of FIG. 1, the use of a metallized layer 14 on the ribbons 8 and 13 also functions to reduce shadow effects due to the pattern of a screen electrode as employed in FIG. 1.

The invention claimed is:

1. A printing ribbon adapted to be placed between a writing electrode and a permeable counterelectrode for transferring marking material thereof to a record adjacent the outer side of said counterelectrode on experiencing multiple dielectric breakdowns in response to voltages applied directly across said writing and counter-electrodes, said ribbon comprising a discrete continuous layer of dielectric material having a predetermined breakdown voltage of lesser magnitude than the voltage applied across said writing and permeable counter-electrodes, pigments within said layer, said pigmented layer constituting said marking material.

2. A printing ribbon as recited in claim 1 wherein said layer is a self-supporting film.

3. A printing ribbon as recited in claim 1 including a conductive paper carrier and wherein said layer is coated on one side of said paper carrier.

4. A printing ribbon as recited in claim 1 wherein said layer has a vaporized metal coating on one side which serves as the permeable counterelectrode.

5. A printing ribbon as recited in claim 2 wherein said self-supporting layer comprises a cast mixture of the following parts by weight:

24.6 special graphite powder;

37.5 parts carbon black;

138 parts polyvinyl alcohol, highly viscous, partly saponified, such as known by the tradename "Mowiol solution 40/88", 15% in water;

17.2 parts glycerin-triox-ethyl ether; and 180 parts water.

* * * * *